United States Patent [19]

Dümmel

[11] 4,076,056

[45] Feb. 28, 1978

[54] WIRE WRAPPING DEVICE FOR CONNECTING AN INSULATED ELECTRICAL WIRE TO AN ELECTRICAL CONTACT PIN

[75] Inventor: Fritz Dümmel, Nuremberg, Germany

[73] Assignee: Siemens Aktiengesellschaft, Munich, Germany

[21] Appl. No.: 683,689

[22] Filed: May 6, 1976

[30] Foreign Application Priority Data

May 26, 1975 Germany ..... 2523247

[51] Int. Cl.[2] ..... B21F 15/04

[52] U.S. Cl. ..... 140/119; 29/751; 29/753; 140/124; 242/7.17

[58] Field of Search ..... 242/7.17; 140/119, 122, 140/124, 115; 29/203 H, 203 B, 203 D, 203 DT, 628, 748, 750, 751, 753

[56] References Cited

U.S. PATENT DOCUMENTS

| | | | |
|---|---|---|---|
| 3,882,906 | 5/1975 | Steiner et al. | 140/124 |
| 3,893,491 | 7/1975 | Jackson, Jr. et al. | 140/122 |

*Primary Examiner*—Carl E. Hall

*Attorney, Agent, or Firm*—Kenyon & Kenyon, Reilly, Carr & Chapin

[57] ABSTRACT

A wire wrapping device for connecting an insulated electrical wire to an electrical contact pin. The device includes a wrapping sleeve and a rotatable cylindrical wrapping spindle disposed within the wrapping sleeve which has an axially-disposed aperture opening at one end thereof for receiving the contact pin and a continuous wire guiding canal disposed in the surface of the spindle. Curved, U-shaped stripping knives are disposed in the canal and open towards the surface of the spindle for receiving and cutting the insulation from the wire. Specifically, the knives define a first cutting opening having a width which corresponds to the cross-sectional dimension of the insulated electrical wire and a second cutting opening which has a width which is at least the same as the diameter of the core of the wire. The improvement of the invention comprises the disposition of the stripping knives in the wire guiding canal so that the longitudinal axes thereof are disposed at an angle ranging between about 30° and about 60° with respect to the tangent at the wire guiding canal on the surface of the wrapping spindle. In addition, the knives are positioned from the end face of the spindle at which the axially-disposed aperture opens by a distance which is at least several times greater than the diameter of the insulated electrical wire.

4 Claims, 3 Drawing Figures

WIRE WRAPPING DEVICE FOR CONNECTING AN INSULATED ELECTRICAL WIRE TO AN ELECTRICAL CONTACT PIN

BACKGROUND OF THE INVENTION

1. Field of the Invention

This invention relates generally to wire wrapping devices, and in particular to an improved wire wrapping device for connecting an insulated electrical wire to an electrical contact pin.

2. Description of the Prior Art

Wire wrapping devices for connecting an insulated electrical hookup wire to an electrical contact pin are known in the art. See, for example, German Pat. No. 1,949,144. These known wrapping devices include a stationary wrapping sleeve in which a cylindrical wrapping spindle, having an aperture in one end face for receiving the contact pin and a continuous wire guiding canal disposed in its surface, is rotatably disposed. Horseshoe-shaped stripping knives disposed in the canal open towards the surface of the spindle. The knives define at least one cutting opening which corresponds in width to the cross-sectional dimension of the electrical hookup wire. Each also defines another cutting opening which has a width equal to at least the diameter of the core of the electrical wire.

In these known wire wrapping devices, the stripping knives are formed by a wedge-shaped intersection between one end face of the wrapping spindle and the end face of a connecting canal disposed between the wire guiding canal and the stripping knives and ending a short distance in front of the end face of the wrapping spindle. In addition, in these known wrapping devices, the aperture which receives the electrical contact pin is offset with respect to the central, longitudinal axis of the wrapping spindle by so great a distance that the minimum spacing between the contact pin and the wrapping sleeve which protrudes beyond the wrapping spindle is somewhat smaller than the diameter of the insulated electrical hookup wire.

Wrapping devices of the foregoing type have found considerable acceptance in making "standard" wrapped wire connections in which the full wrap consists of a bare electrical wire. In addition to these standard-type wrapped wire connections, there are also the so-called "modified" wrapped wire connections in which at least one turn of the electrical insulation of the wire is also wrapped on the contact pin. There is a need in the art for a wire wrapping device with which such a modified wrapped wire connection can be made with the electrical wire perfectly stripped.

SUMMARY OF THE INVENTION

It is therefore an object of the present invention to provide an improved wire wrapping device for connecting an insulated electrical wire to an electrical contact pin which enables a modified wrapped wire connection to be made to the contact pin with the electrical insulation of the wire perfectly stripped therefrom.

These and other objects of the invention are achieved in a wire wrapping device for connecting an insulated electrical wire comprising a wire core and electrical insulation surrounding the core to an electrical contact pin, which device includes a wrapping sleeve and a rotatable cylindrical wrapping spindle disposed within the wrapping sleeve. The spindle has an axially-disposed aperture opening at one end thereof for receiving the contact pin and includes a continuous wire guiding canal disposed in the surface of the spindle. The canal also has curved, U-shaped stripping knives disposed therein which open towards the surface of the spindle for receiving and cutting the electrical insulation from the wire. Specifically, the knives define a first cutting opening having a width which corresponds to the cross-sectional dimension of the insulated electrical wire and a second cutting opening which has a width which is at least the same as the diameter of the core of the wire. The improvement of the invention comprises the disposition of the stripping knives in the wire guiding canal so that their longitudinal axes are disposed at an angle ranging between about 30° and about 60° with respect to the tangent at the wire guiding canal on the surface of the wrapping spindle. In addition, the knives are positioned from the end face of the spindle at which the axially-disposed aperture for receiving the contact pin opens by a distance which is at least several times greater than the diameter of the insulated electrical wire.

With such an arrangement, the wire insulation disposed in the wire guiding canal ahead of the knives, i.e., between the stripping knives and the end face of the wrapping spindle, is available to make a modified wire wrapping connection on the contact pin and simultaneously a clean cut is made around and into the electrical insulation in the canal as a result of the relative rotating motion of the stripping knives about the hookup wire at the start of the wire wrapping operation. Reliable stripping of the insulation from the wire core is thus obtained.

The stripping knives are preferably U-shaped cutting blades and the first and second cutting openings are defined by the blades so that the width of the knives increase outwardly towards the surface of the wrapping spindle from a width equal to at least the diameter of the core of the wire to a width equal to the diameter of the insulated electrical wire. At the start of the insulation stripping operation, the outer part of the knife blades, which define the first cutting opening, cut the insulation first, the insulation then being held fast by the inner portion of the blades defining the second cutting opening which receives the wire core.

The aperture which receives the contact pin is preferably disposed coaxially with respect to the longitudinal, central axis of the wrapping spindle. This prevents oscillating movement of the wrapping device during wrapping of the wire and assures proper circumferential cutting of the wire insulation. Such an arrangement is extremely advantageous if the wrapping device is positioned by numerical control.

The stripping knives are preferably formed from cross members disposed in the wire guiding canal by means of electrolytic removal of material from the surface of the cross members.

These and other features of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
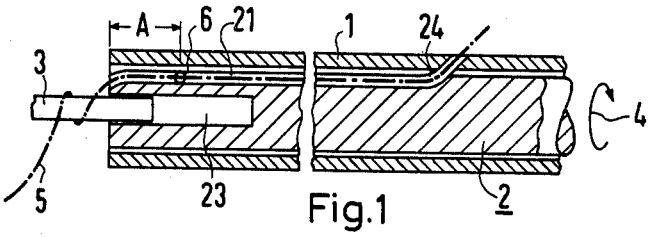
FIG. 1 is a partial, longitudinal cross-sectional view of an improved wire wrapping device constructed according to the invention.
Figure 2:
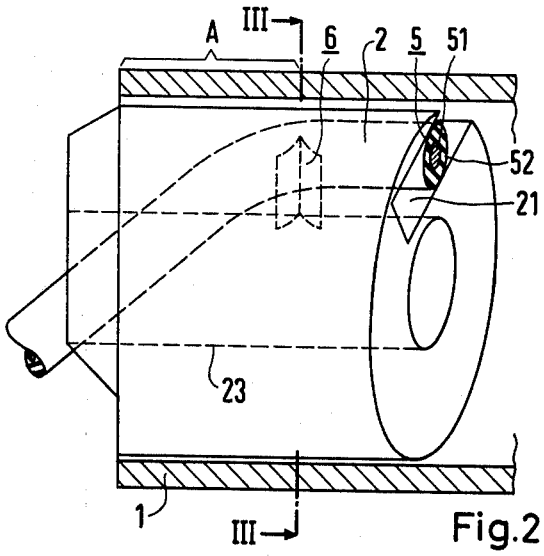
FIG. 2 is an enlarged, perspective view, partly in section, of one end of a wire wrapping device constructed according to the invention.

Referring now to the drawings, there is shown a wire wrapping device for connecting several turns of an insulated electrical hookup wire 5 to an electrical contact pin 3 of a contact panel. The wrapping device includes a cylindrical wrapping spindle 2 which is rotatably disposed in a stationary wrapping sleeve 1 which surrounds the spindle. A continuous wire guiding canal 21 is provided in the surface of the wrapping spindle and is bounded on one side by the inside surface of the wrapping sleeve. The spindle also includes an axially-disposed aperture 23 which opens at one end thereof for receiving contact pin 3.

Figure 3:
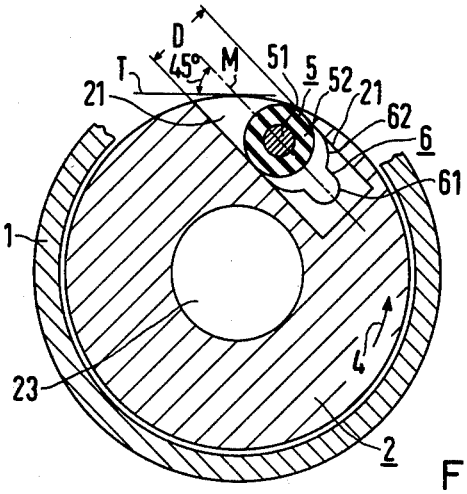
FIG. 3 is a cross-sectional end view of the wire wrapping device taken along Section III—III of FIG. 2.

As shown in FIG. 3, curved, U-shaped (horseshoe-shaped) stripping knives 6 are disposed in wire guiding canal 21 and open towards the surface of the wrapping spindle. Specifically, the stripping knives comprise an outer, U-shaped knife blade 62 which defines a first cutting opening having a shape corresponding to that of the insulated electrical wire and a width dimension which corresponds to the diameter D of the insulated electrical wire. The knives also define a second cutting opening disposed between another curved, U-shaped blade 61 which is at least the same in width, and in the illustrated embodiment of the invention, slightly greater in width than, the diameter of the core 51 of the electrical wire so as to permit movement of the wire core but not the insulation of the wire through the cutting opening. The stripping knives, whose longitudinal axis or center line is illustrated by the line M in the drawings, are disposed in the wire guiding canal so that the longitudinal axes thereof are disposed at an angle ranging between about 30° and about 60°, and in the illustrated embodiment of the invention, at an angle of about 45°, with respect to the tangent T at the wire guiding canal on the surface of the wrappng spindle 2. The stripping knives are also positioned in wire guiding canal 21 at the point from the end face of the wrapping spindle at which aperture 23 opens by a distance A which is at least several times greater than the diameter D of the insulated electrical wire 5. The stripping knives are preferably formed by electrolytically removing the surface of cross members disposed in the wire guiding canal in such a manner that a sharp blade is produced for cutting the insulation from the wire.

In order to wrap the electrical wire 5 on contact pin 3 in the "modified" wrap connection described previously herein, wire 5 is pushed into canal 21 up to and through an angularly disposed opening 24 provided in wrapping sleeve 1. Contact pin 3 is then inserted into aperture 23 of wrapping spindle 2 and the spindle is rotated in the direction illustrated by the arrow 4 in the drawings about the contact pin. Electrical wire 5 is cut off at opening 24 by this rotating motion between sleeve 1 and spindle 2 by means of cutting edges (not shown), and that part of wire 5 which is disposed in wire guiding canal 21 is pulled out of the canal by the rotating movement of the spindle and is wrapped around the contact pin 3, as illustrated in FIG. 1 of the drawings.

At the start of the wrapping operation, wire 5 is pulled towards blade 62 of the stripping knives, and, simultaneously, a relative rotation of blade 61 with respect to wire 5 occurs as wrapping spindle 2 rotates. As a result, a circular cut of electrical insulation 52 is produced, particularly by the transition point between blades 61 and 62 of the knives. The core 51 of wire 5 can then slip into the second cutting opening defined between the cutting edges of knife blade 61 and the blade holds the insulation back as the wire is pulled towards the contact pin. As a result, the length of wire disposed between the stripping knives and the opening 24 provided in sleeve 1 is wrapped around the contact pin 3 by the rotating movement of wrapping spindle 2.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a wire wrapping device for connecting an insulated electrical wire comprising a wire core and electrical insulation surrounding said core to an electrical contact pin including a wrapping sleeve, a rotatable cylindrical wrapping spindle disposed within said wrapping sleeve having an axially-disposed aperture opening at one end thereof for receiving said contact pin and a continuous wire guiding canal disposed in the surface of said spindle, said canal having curved, U-shaped stripping knives disposed therein opening towards the surface of said spindle for receiving and cutting said electrical insulation from said wire, said knives defining a first cutting opening having a width corresponding to the cross-sectional dimension of said insulated electrical wire and a second cutting opening having a width which is at least the same as the diameter of said wire core, the improvement comprising said stripping knives being disposed in said wire guiding canal so that the longitudinal axes of said knives are disposed at an angle ranging between about 30° and about 60° with respect to the tangent at the intersection of said longitudinal axes of said knives and the surface of said wrapping spindle, and said knives being positioned from the end face of said one end of said spindle by a distance which is at least several times greater than the diameter of said insulated electrical wire.

2. The wire wrapping device recited in claim 1, wherein said stripping knives comprise cutting blades and said first and second cutting openings are defined by said knives so that the width of said knives increases towards the surface of said spindle from said width equal to at least the diameter of said core of said wire to said width equal to the diameter of the insulated electrical wire.

3. The wrapping device recited in claim 1, wherein said axially-disposed aperture for receiving said contact pin is coaxially disposed with respect to the longitudinal axis of said wrapping spindle.

4. The wrapping device recited in claim 1, wherein said stripping knives comprise cross members disposed in said wire guiding canal having cutting blades formed thereon by means of electrolytic removal of the surface of said cross members.

* * * * *